US005318621A

United States Patent [19]

Krulik et al.

[11] Patent Number: 5,318,621

[45] Date of Patent: Jun. 7, 1994

[54] PLATING RATE IMPROVEMENT FOR ELECTROLESS SILVER AND GOLD PLATING

[75] Inventors: Gerald A. Krulik, Lake Forest, Calif.; Nenad V. Mandich, Homewood, Ill.; Rajwant Singh, Fullerton, Calif.

[73] Assignee: Applied Electroless Concepts, Inc., Lake Forest, Calif.

[21] Appl. No.: 104,723

[22] Filed: Aug. 11, 1993

[51] Int. Cl.[5] ..... C23C 18/31

[52] U.S. Cl. ..... 106/1.23; 106/1.26

[58] Field of Search ..... 106/1.23, 1.26

[56] References Cited

U.S. PATENT DOCUMENTS

| | | | |
|---|---|---|---|
| 4,142,902 | 3/1979 | Burke et al. | 106/1.23 |
| 4,374,876 | 2/1983 | El-Shazly et al. | 106/1.25 |
| 4,880,464 | 11/1989 | Ushio et al. | 106/1.26 |
| 5,106,413 | 4/1992 | Takehawa | 106/1.23 |
| 5,178,918 | 1/1993 | Duva et al. | 106/1.23 |
| 5,232,492 | 8/1993 | Krulik et al. | 106/1.23 |

FOREIGN PATENT DOCUMENTS

| | | |
|---|---|---|
| 215677 | 9/1991 | Japan . |
| 314871 | 11/1992 | Japan . |

OTHER PUBLICATIONS

G. Mallory, J. Hajdu, Eds., "Electroless Plating: Fundamentals and Applications", 1990, American Electroplaters & Surface Finishers Soc, Ch. 15 Electroless Plating of Gold . . . ; Ch. 17, Electroless Plating of Silver.

*Primary Examiner*—Helene Klemanski

[57] ABSTRACT

An electroless silver or gold plating solution comprising a noncyanide metal complex, a thiosulfate, a sulfite, and at least one amino acid. These electroless plating solutions containing an amino acid exhibit an accelerated plating rate compared to identical solutions lacking amino acids.

14 Claims, No Drawings

PLATING RATE IMPROVEMENT FOR ELECTROLESS SILVER AND GOLD PLATING

The present invention relates to electroless silver and gold plating solutions comprising a noncyanide metal complex, a thiosulfate, and a sulfite; and containing one or more water soluble amino acids. The electroless plating solutions containing an amino acid exhibit an accelerated plating rate compared to otherwise identical solutions lacking amino acids.

Previously known electroless plating solutions use a reducing agent system of sulfite and thiosulfate which is low in toxicity. This reducing agent system is very stable, but plating rates are low. Typical plating rates are 0.25–0.5 microns of thickness in 15 minutes. While such rates are useful, for some purposes for commercial use it would be desirable if the plating rate could be increased. Any such plating rate accelerators should be low in toxicity to maintain the low degree of hazard of the plating system. Plating rate accelerators also should have no deleterious effects on plating bath stability or deposit appearance. It has been discovered that amino acids are ideal plating rate accelerators for these electroless silver and gold systems. These plating rate accelerators function without any decrease of the excellent stability of thiosulfate/sulfite electroless silver and gold baths against spontaneous decomposition.

BACKGROUND OF THE INVENTION

Many types of electroless gold plating rate accelerators have been used, as reviewed in Electroless Plating-:Fundamentals & Applications, edited by G. O. Mallory and J. B. Hajdu, and published by American Electroplaters and Surface Finishers Society, Orlando, Fla., 1990. This work discusses electroless gold in great detail in Chapter 15. No electroless golds based on a noncyanide thiosulfate/sulfite system were disclosed in this work. The most common formulations of electroless golds are based on gold cyanide complexes, with the addition of reducing agents such as dimethylamine borane, formaldehyde, sodium borohydride, hydrazine, etc. Metals such as lead and thallium, highly toxic materials, are listed as plating rate enhancers in these systems. Organic stabilizers such as compounds containing N-carboxymethyl groups have been used as stabilizers to allow higher temperature operation, thus increasing the plating rate (A. Kasugai, Kokai Tokkyo Koho, 80-24914, 1980). Glycine and N,N diethylglycine have been listed as components of some gold cyanide electroless plating solutions.

The same reference reviews the state of the art of electroless silver plating in Chapter 11. None of the disclosed formulations are based on thiosulfate plus sulfite salts. No plating rate accelerators were listed as being useful for any type of electroless silver plating baths. Most of the electroless silver plating solutions are based on literature recipes such as those described in Metal Finishing Guidebook and Directory, (1993 edition) comprising silver nitrate, ammonia, and a reducing agent such as formaldehyde or a reducing sugar. A few newer formulas have been patented, such as U.S. Pat. No. 4,863,766 which discloses electroless silver plating with a bath comprising a silver cyanide complex, another cyanide compound, and hydrazine as the reducing agent. Another formulation which has been disclosed contains silver potassium cyanide, potassium cyanide and a borane compound as the reducing agent (Platino, 57 (1970), pp. 914–920). This plating solution is said to allow a plating rate of 1 micrometer/hr with some stability. However, since these plating solutions contains a large amount of cyanide ions, there is a safety problem in operation of the solutions and in disposal of waste baths, rinses, and dragout.

Electroless silver plating solutions are generally considered to be borderline catalytic electroless metals. True electroless metals such as copper and nickel can continuously build total metal thickness to indefinitely thick coatings of 25 microns (0.001 inch) or more. The freshly deposited copper or nickel is fully catalytic and remains capable of initiating further electroless metal deposition. Most electroless silver baths, by contrast, rapidly lose autocatalytic activity. The freshly deposited silver metal is rarely able to continue catalytic activity beyond 0.25 microns (0.000010 inch).

Electroless gold baths based on a non-cyanide gold salt, and a combination of thiosulfate and sulfite salts are fully catalytic but have relatively slow plating rates of 1 to 1.5 microns per hour. Electroless silver baths based on a combination of thiosulfate and sulfite salts are fully catalytic, but have relatively slow plating rates of 1 to 1.5 microns per hour. It has now been discovered that amino acids are effective rate enhancers for increasing the speed of deposition of both electroless gold and electroless silver baths based on such formulations.

SUMMARY OF THE INVENTION

Electroless gold plating baths based on a combination of thiosulfate and sulfite salts have been disclosed in pending U.S. patent application Ser. No. 07-824076 filed Jan. 23, 1992, now U.S. Pat. No. 5,232,492 Electroless silver plating based on a combination of thiosulfate and sulfite salts have been disclosed in pending U.S. patent application Ser. No. 08-020618 filed Feb. 22, 1993. The disclosure of these applications are incorporated by this reference. These plating baths contain no ammonia or cyanide ions as plating constituents or stabilizers, yet have plating solution stability far greater than any previously known electroless gold or silver baths. These electroless gold and silver formulations have a relatively slow plating rate. One object of the present invention is to provide such electroless gold and silver plating solutions which achieve an increased plating rate. The reason for their effect is unknown, but the addition of amino acids do not decrease the extremely good bath stability even though the plating rate is greatly increased. This novel effect of greater plating rate with retention of stability is highly desirable in commercial electroless gold and silver plating baths.

Numerous amino acids are suitable for use in this process. Amino acids vary greatly in molecular weight, water solubility, cost, molecular polarizability, and other properties. Glycine is the simplest amino acid, is low in cost, has a low molecular weight, and is highly water soluble. Glycine has been found to be an effective plating rate enhancer over a wide concentration range. Mixtures of amino acids are also suitable plating rate enhancers.

The effective amount of amino acid can vary with the exact formulation of the electroless gold or silver plating bath, depending on the pH, temperature, ratio of thiosulfate to sulfite, and concentration of metal. The effective amount of amino acid(s) showing plating rate enhancement is from less than one gram per liter to near saturation. In general, the most economical range is from approximately 1 g/l to 200 g/l and most preferably from about 2 g/l to about 100 g/l.

DETAILED DESCRIPTION OF THE PREFERRED EMBODIMENTS

Neither electroless gold nor electroless silver plating baths based on the thiosulfate plus sulfite formulations will plate directly upon copper, the copper being rapidly dissolved without allowing a silver or gold layer to form. Thiosulfate/sulfite based silver and gold plating baths will plate directly upon electroless nickel and electrolytic nickel, so in the examples which follow, all test pieces were copper clad printed circuit boards coated with electroless nickel.

Although the disclosure hereof is detailed and exact, the formulations listed in the examples are merely illustrative of the useful amounts and types of amino acids. Any formulator skilled in the art can utilize these examples and this concept to prepare many workable solutions in addition to those shown in the examples.

Test articles were one ounce per square foot copper foil clad epoxy glass laminate printed circuit board material. These boards were cut into 2.5 cm by 7.5 cm sections for convenience of use. The cleaner was Excelclean C-18. The microetchant was ACI Microetch E-20. The activator was ACI Activator A-40. The electroless nickel was ACI Electroless Nickel N-50. All ACI products are commercially available from Applied Electroless Concepts, Inc, Anaheim, California. The autocatalytic electroless silver and gold formulations used are given in the examples.

SAMPLE PREPARATION FOR EXAMPLES

Test panels were copper-clad double sided printed circuit boards 2.5 by 7.5 cm pieces. Test panels were all given a standard process cycle to get a fresh electroless nickel coating before the electroless gold or silver plating. This cycle is given in Table I. Tap water running rinses are understood between each process step.

TABLE I

| STANDARD PROCESS CYCLE | |
|---|---|
| Clean | Excelclean C-18; 1 min; 45° C.; then rinse |
| Microetch | ACI Microetch E-20 ; 1 min, 35° C.; then rinse |
| Pre Dip | ACI Predip D-30; 0.5 min, room temperature; then rinse |
| Catalyst | ACI Activator A-40; 1 min, 45° C.; then rinse |
| Electroless nickel | ACI Electroless Nickel N-50; 20 min, 90° C.; then rinse |

EXAMPLES 1-9

Each of the solutions in Examples 1 through 9 was tested with additions of 0 g/l, 2 g/l, 5 g/l, and 8 g/l glycine. The solutions were heated to the indicated temperature before being used. The test conditions are summarized in Table II and the test results are summarized in Table III. Other amino acids such as alanine, glutamine, leucine, and isoluecine were also tested and found to be satisfactory.

In general the concentration of sodium thiosulfate should be from 1 to 200 g/l and the ratio of sodium thiosulfate to sodium sulfite should be between 200:1 and 1:10 with ratios of from 10:1 to 1:1 being preferred. The pH should be between 7 and 9, preferably between 7.5 and 8.5, and the temperature of the bath should be between 35 and 90° C. The amount of gold or silver should be up to 10 g/l and should be in the form of a non-cyanide complex with sulfite or thiosulfate.

TABLE II

TEST CONDITIONS FOR EXAMPLES 1-9

| EXAMPLE | SODIUM THIO-SULFATE, g/l | SODIUM SULFITE, g/l | DISODIUM EDTA, g/l | SILVER g/l AS SILVER COMPLEX | pH | °C. |
|---|---|---|---|---|---|---|
| 1 | 200 | 20 | 0.1 | 3 | 7.5 | 65 |
| 2 | 200 | 1 | 0.1 | 3 | 7.5 | 65 |
| 3 | 10 | 2 | 0.1 | 3 | 8.5 | 80 |
| 4 | 5 | 50 | 0.1 | 3 | 8.0 | 50 |
| 5 | 20 | 20 | 0.1 | 6 | 8.5 | 60 |
| 6 | 20 | 20 | 0.1 | 1 | 8.5 | 90 |
| 7 | 100 | 5 | 0.1 | 10 | 8.0 | 40 |
| 8 | 10 | 0.2 | 0.1 | 3 | 7.5 | 60 |
| 9 | 10 | 0.2 | 0 | 3 | 7.5 | 60 |

TABLE III

TEST RESULTS FOR EXAMPLES 1-9

| Example | Temp., °C. | Plating rate, microns in 15 minutes. Glycine, g/l 0 | 2 | 4 | 8 |
|---|---|---|---|---|---|
| 1 | 65 | 1.55 | 4.1 | 2.38 | 4.05 |
| 2 | 65 | 1.1 | 3.35 | 3.5 | 3.38 |
| 3 | 80 | D | 0.83 | 0.90 | 1.08 |
| 4 | 50 | D | 0.28 | 0.93 | 1.2 |
| 5 | 60 | D | 0.75 | 0.85 | 0.43 |
| 6 | 90 | None | 3.3 | 4.93 | 2.88 |
| 7 | 40 | D | 1.95 | 1.6 | 1.05 |
| 8 | 60 | 0.5 | 0.7 | 0.8 | 0.98 |
| 9 | 60 | 0.5 | 0.73 | 1.15 | 0.73 |

D = discontinuous silver coating.

EXAMPLES 10-26

The silver solutions consisted of a solution of 200 g/l sodium thiosulfate, 20 g/l of sodium sulfite, 0.1 g/l of disodium EDTA, and 2.5 g/l of silver as a silver(I) complex. The gold solutions were the same except that 10 g/l of sodium sulfite was used. The pH was adjusted to pH 8.0 and the solution heated to 71° C. Test samples were plated for 15 minutes. 10 g/l of each amino acid was added, so the concentrations were 10 g/l of total amino acid for single amino acids, 20 g/l of total amino acid for two amino acid mixtures, and 30 g/l of total amino acid for three amino acid mixtures.

TABLE IV

TEST RESULTS FOR EXAMPLES 11-26

| EXAMPLE | AMINO ACID | METAL | MICRONS IN 10 MINUTES |
|---|---|---|---|
| 11 | NONE | SILVER | 0.43 |
| 12 | LEUCINE | SILVER | 0.76 |
| 13 | GLYCINE | SILVER | 1.39 |
| 14 | ALANINE | SILVER | 2.96 |
| 15 | LYSINE | SILVER | 3.68 |
| 16 | VALINE | SILVER | 1.29 |
| 17 | GLUTAMINE | SILVER | 2.72 |

TABLE IV-continued

TEST RESULTS FOR EXAMPLES 11-26

| EXAMPLE | AMINO ACID | METAL | MICRONS IN 10 MINUTES |
|---|---|---|---|
| 18 | NONE | GOLD | 0.19 |
| 19 | LEUCINE | GOLD | 0.39 |
| 20 | ALANINE | GOLD | 0.43 |
| 21 | LYSINE | GOLD | 0.63 |
| 22 | VALINE | GOLD | 0.78 |
| 23 | GLYCINE | GOLD | 0.71 |
| 24 | GLYCINE + ALANINE | SILVER | 1.31 |
| 25 | GLYCINE + ALANINE | GOLD | 1.0 |
| 26 | GLYCINE + ALANINE + LEUCINE | SILVER | 2.66 |

What is claimed is:

1. An electroless plating solution for depositing gold or silver on a suitable substrate comprising water, a non cyanide metal complex wherein the metal is selected from the group consisting of gold and silver, a thiosulfate, a sulfite, and at least one amino acid, the concentration of said thiosulfate being from 1-200 g/l and the ratio of said thiosulfate to said sulfate being between 200/1 and 1/10, said solution having a pH above 7.

2. An electroless plating solution according to claim 1, wherein said amino acid is selected from the group consisting of water soluble amino acids.

3. An electroless plating solution according to claim 1, wherein said amino acid is glycine.

4. An electroless plating solution according to claim 1, wherein said amino acid is alanine.

5. An electroless plating solution according to claim 1, wherein said amino acid is lysine.

6. An electroless plating solution according to claim 1, wherein said amino acid is leucine.

7. An electroless plating solution according to claim 1, wherein said amino acid is glutamine.

8. An electroless plating solution according to claim 1, wherein said amino acid is valine.

9. An electroless plating solution according to claim 1, wherein said amino acid comprises a mixture of two amino acids.

10. An electroless plating solution according to claim 1, wherein said amino acid comprises a mixture of at least three amino acids.

11. An electroless plating solution according to claim 1, wherein the concentration of said amino acid is between 2 and 100 g/l.

12. An electroless plating solution according to claim 1 wherein the concentration of said amino acid is an effective amount from less than 1 gram/liter to near saturation.

13. An electroless plating solution according to claim 1 whereas the ratio of thiosulfate to sulfite is between 10/1 and 1/1.

14. An electroless plating solution according to claim 1 whereas the pH is between 7 and 9.

* * * * *